US011142005B2

(12) United States Patent
Kobayashi et al.

(10) Patent No.: US 11,142,005 B2
(45) Date of Patent: Oct. 12, 2021

(54) INKJET PRINTER

(71) Applicant: Roland DG Corporation, Hamamatsu (JP)

(72) Inventors: Ryosuke Kobayashi, Hamamatsu (JP); Masanori Ishihara, Hamamatsu (JP); Akihiro Suzuki, Hamamatsu (JP)

(73) Assignee: ROLAND DG CORPORATION, Hamamatsu (JP)

( * ) Notice: Subject to any disclaimer, the term of this patent is extended or adjusted under 35 U.S.C. 154(b) by 0 days.

(21) Appl. No.: 16/899,391

(22) Filed: Jun. 11, 2020

(65) Prior Publication Data

US 2020/0391526 A1 Dec. 17, 2020

(30) Foreign Application Priority Data

Jun. 12, 2019 (JP) ..... JP2019-109196

(51) Int. Cl.
*B41J 25/00* (2006.01)

(52) U.S. Cl.
CPC ..... *B41J 25/001* (2013.01)

(58) Field of Classification Search
CPC ..... B41J 25/001
See application file for complete search history.

(56) References Cited

U.S. PATENT DOCUMENTS

2005/0151773 A1* 7/2005 Watarai ..... B41J 11/20 347/16
2018/0147782 A1* 5/2018 Kobayashi ..... B41J 11/20

FOREIGN PATENT DOCUMENTS

JP 2017-121712 7/2017

* cited by examiner

*Primary Examiner* — Justin Seo
(74) *Attorney, Agent, or Firm* — Knobbe, Martens, Olson & Bear LLP

(57) ABSTRACT

A printer can comprise a supporting wall that extends in a primary scanning direction, a table that is positioned lower than the supporting wall and that is structured so as to be able to move in a secondary scanning direction, a guide rail equipped on the supporting wall that extends in the primary scanning direction, a head carriage that is provided slidably on the guide rail and that can move in the primary scanning direction, an ink head mounted on the head carriage, and a partitioning wall that is positioned lower than the supporting wall and to a side of the table in the primary scanning direction and that extends in the secondary scanning direction and the vertical direction. When the table is positioned at the maximally downstream position along the secondary scanning direction, the upstream end portion of the table is positioned further downstream of the supporting wall and further upstream than the downstream end portion of the partitioning wall.

14 Claims, 8 Drawing Sheets

INKJET PRINTER

INCORPORATION BY REFERENCE TO ANY PRIORITY APPLICATIONS

Any and all applications for which a foreign or domestic priority claim is identified in the Application Data Sheet as filed with the present application are hereby incorporated by reference under 37 CFR 1.57.

BACKGROUND OF THE INVENTIONS

Field of the Technology

The present inventions relate to inkjet printers.

Description of the Related Art

Japanese Unexamined Patent Application Publication 2017-121712 describes a printer comprising an inner wall that extends in the primary scanning direction, a guide rail equipped on the inner wall, a carriage equipped slidably on the guide rail, an ink head mounted on the carriage, a placement platform on which a printing medium is placed, and a moving device for moving the placement platform in the secondary scanning direction, which is perpendicular, in the plan view, to the primary scanning direction. In that printer, an ink head discharges ink onto a printing medium that is placed on the placement platform, as the ink head is moved in the primary scanning direction. Thereafter, the printing medium that is placed on the placement platform is moved in the secondary scanning direction, by the moving device. A prescribed image is printed on the printing medium through performing this repetitively.

SUMMARY OF THE INVENTIONS

In some printers wherein the placement platform is moved in the secondary scanning direction, a movement space within which the placement platform moves, is below the inner wall that extends in the primary scanning direction. The inner wall supports the guide rail. Given this, when the placement platform is positioned at the downstream end of its movement range, in the secondary scanning direction, a gap is opened between the placement platform and the inner wall on which the guide rail is provided. The interior of the movement space can be accessed through the gap. Because of this, it is possible that an operator, or the like, could place an article, such as a tool, into the movement space by accident. When the placement platform is then moved in the secondary scanning direction, the article inserted into the movement space through the gap can interfere with the movement of the placement platform.

At least one of the inventions disclosed herein include contemplation of this point, and thus the object thereof is to provide an inkjet printer the that is equipped with a placement platform that moves in the secondary scanning direction, and wherein entry of a relatively large article into the movement space of the placement platform can be prevented.

An ink jet printer according to an embodiment can comprise a base member a supporting wall that is positioned higher than the base member and that extends in a primary scanning direction, a placement platform that is positioned lower than the supporting wall, structured so as to be able to move in a secondary scanning direction that is a direction that is perpendicular to the primary scanning direction, and on which a printing medium is placed. A moving device can move the placement platform in an outbound direction that is the direction from the upstream side to the downstream side of the secondary scanning direction and in a return direction that is the direction from the downstream side toward the upstream side of the secondary scanning direction. A guide rail that is provided on the supporting wall and extends in the primary scanning direction. A carriage is provided slidably on the guide rail and can move in the primary scanning direction. An ink head is installed on the carriage and is structured so as to be able to discharge ink toward a printing medium that is placed on the placement platform. A partitioning wall is positioned lower than the supporting wall and to a side of the placement platform in the primary scanning direction, and extends in the secondary scanning direction and in the vertical direction. When the placement platform is positioned at the maximally downstream side in the secondary scanning direction, the end portion on the upstream side, in the secondary scanning direction, of the placement platform is positioned further toward the downstream side in the secondary scanning direction than the supporting wall, and further toward the upstream side in the secondary scanning direction than the end portion of the downstream side, in the secondary scanning direction, of the partitioning wall.

In an inkjet printer according to some embodiments, the partitioning wall is positioned lower than the supporting wall and to the side of the placement platform in the primary scanning direction, extending in the secondary scanning direction in the vertical direction. When the placement platform is positioned at the maximally downstream side in the secondary scanning direction, the end portion of the upstream side, in the secondary scanning direction, of the placement platform will be positioned further toward the downstream side, in the secondary scanning direction, than the supporting wall. That is, a gap will exist between the placement platform and the supporting wall.

However, when the placement platform is positioned at the maximally downstream side, in the secondary scanning direction, the end portion of the upstream side, in the secondary scanning direction, of the placement platform will be positioned further toward the upstream side, in the secondary scanning direction, than the end portion on the downstream side, in the secondary scanning direction, of the partitioning wall. That is, the gap, described above, will be blocked by the partitioning wall that is disposed to the side of the placement platform, preventing entry of a relatively large article, such as a tool, into the movement space of the placement platform through the gap from the side of the placement platform.

As such, in some embodiments, the above structures provides an inkjet printer that is able to prevent entry of a relatively large article into the movement space of a placement platform.

BRIEF DESCRIPTIONS OF THE DRAWINGS

DETAILED DESCRIPTION OF THE PREFERRED EMBODIMENTS

Inkjet printers (hereinafter termed "printer") according to several embodiments are explained below in reference to the drawings. Note that, of course, embodiments explained herein are not intended to particularly limit the present inventions. Additionally, members and parts that have identical effects are assigned identical reference symbols, and redundant explanations are omitted or abbreviated, as appropriate.

Figure 1:
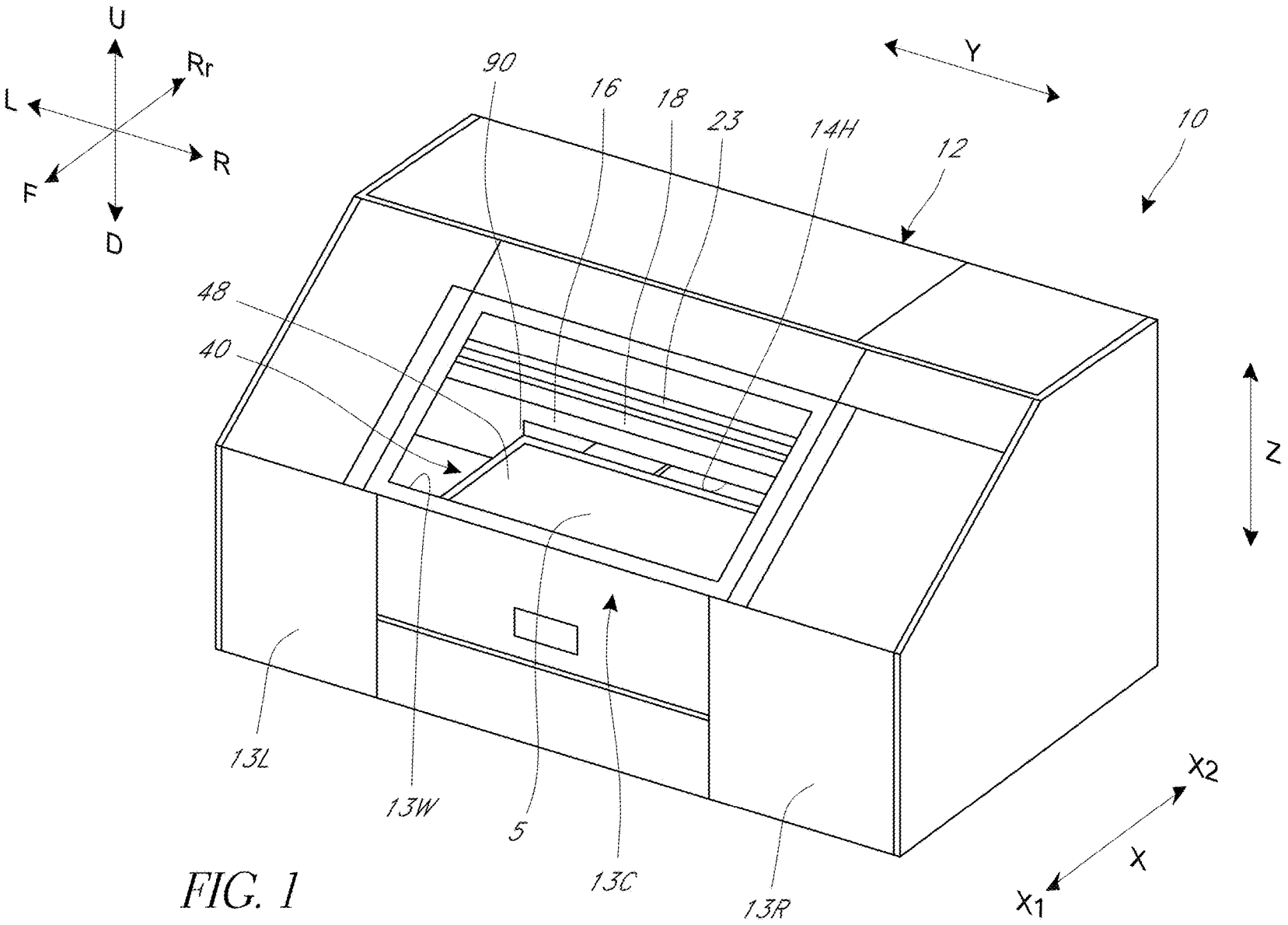
FIG. 1 is a perspective view of a printer according to one embodiment.

FIG. 1 is a perspective diagram of a printer 10 according to the present embodiment. In the explanation below, the direction away from the printer 10, when the printer 10 is viewed from the front, is defined as "forward," and the direction toward the printer 10 is defined as "rearward." "Left," "right," "up," and "down" have the respective meanings of left, right, up, and down when the printer 10 is viewed from the front. Moreover, in the drawings the reference symbols F, Rr, L, R, U, and D have, respectively, the meanings of front, rear, left, right, up, and down. Furthermore, the reference symbol Y in the drawings indicates the primary scanning direction. Here the primary scanning direction Y is the crosswise direction. The reference symbol X indicates the secondary scanning direction. Here the second or scanning direction X is the front/rear direction, and, in the plan view, is perpendicular to the primary scanning direction Y. The reference symbol Z indicates the vertical direction. Moreover, the back side of the printer 10 is termed the "upstream side," and the front side of the printer 10 is termed the "downstream side." Moreover, in the present embodiment, the direction from the upstream side to the downstream side in the secondary scanning direction X is defined as the "outbound direction X1," and the direction from the downstream side toward the upstream side in the secondary scanning direction X is defined as the "return direction X2." Note that the directions described above are no more than directions that are established for convenience in explanation, and in no wise constrain the form in which the printer 10 is installed, nor limit the present invention in any way.

The printer 10 is an inkjet-type printer. The printer 10 is a so-called "large printer," wherein the primary scanning direction Y is long when compared to a printer for home use. For example, the printer 10 is a printer for industrial use. In the present embodiment, the printer 10 prints an image onto a printing medium 5.

The printing medium 5 is, for example, printer paper. However, the printing medium 5 is not limited to printer paper. For example, the "printing medium 5" includes sheets formed from resin materials such as polyvinyl chloride (PVC), polyester, or the like, metal plates formed from, for example, aluminum or iron, and materials that are relatively thick, such as sheets of glass, sheets of wood, and so forth.

Figure 2:
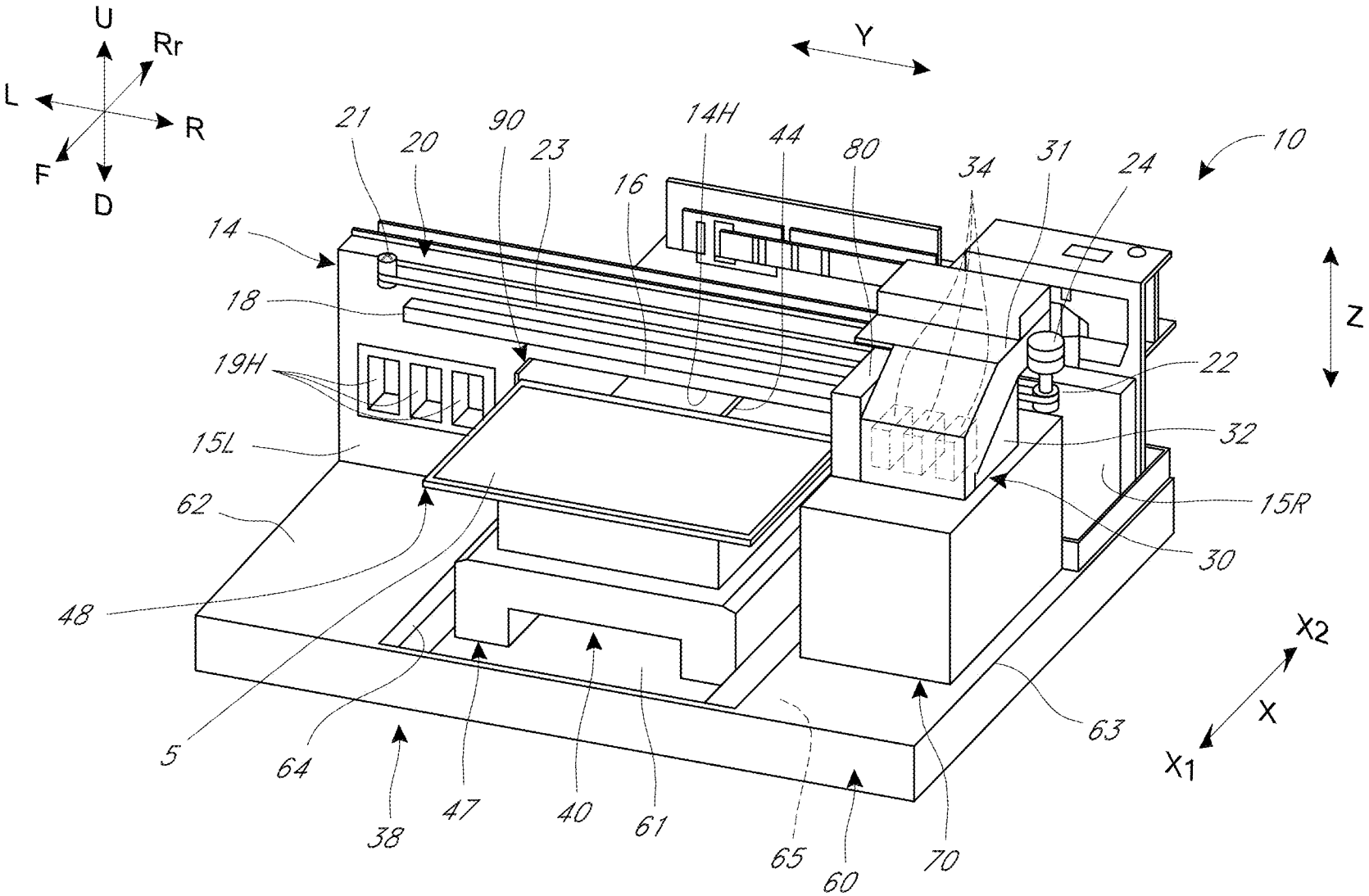
FIG. 2 is a perspective view of a printer in a state wherein the main unit case is removed, according to one embodiment.

As illustrated in FIG. 2, the printer 10 comprises a base member 60, a main unit case 12 (referencing FIG. 1) that is attached to the base member 60, a carriage moving mechanism 20, a table moving mechanism 38, an ink head unit 30, and a maintenance device 70. The printer 10 comprises a main unit frame 14 that supports the carriage moving mechanism 20 and the ink head unit 30. The table moving mechanism 38 has a first slide rail 51 (referencing FIG. 4) and a second slide rail 52 (referencing FIG. 4) that support the table unit 40, described below, so as to enable movement in the secondary scanning direction X. A table unit 40 has a table 48 for placement of the printing medium 5. A moving device 41 (referencing FIG. 4) can be used for moving the table unit 40 in the secondary scanning direction X. The table 48 is an example of a placement platform.

The ink head unit 30 is disposed on the inside of the main unit case 12. As illustrated in FIG. 2, the ink head unit 30 is disposed higher than the table unit 40.

The ink head unit 30 comprises one or more an ink heads 34, a head carriage 32 on which the ink head 34 is mounted, a case 31 that is attached to the head carriage 32, and a light-emitting device 80. The head carriage 32 is an example of a carriage.

As illustrated in FIG. 1, a front cover 13C is provided in the center of the front portion of the front unit case 12. A left cover 13L is provided on the left of the front portion of the main unit case 12. A right cover 13R is provided on the right of the front portion of the main unit case 12. The front cover 13C, the left cover 13L, and the right cover 13R are structured so as to be able to open and close in respect to the main unit case 12. A window 13W is provided in the front cover 13C. The window 13W is formed from, for example, the transparent acrylic plate. The operator is able to view the interior of the main unit case 12 through the window 13W. The base member 60 (referencing FIG. 2) is attached to the bottom of the main unit case 12. The base member 60 supports the main unit case 12.

As illustrated in FIG. 2, the base member 60 includes: a bottom wall 61 that serves as a structure of the bottom surface; a left wall 62 that is positioned to the left and above the bottom wall 61; a right wall 63 that is positioned to the right and above the bottom wall 61; a left side wall 64 that connects the bottom wall 61 and the left wall 62 and that extends in the vertical direction Z; and a right side wall 65 that connects the bottom wall 61 and the right wall 63 and that extends in the vertical direction Z. The table unit 40 moves in the secondary scanning direction X, over the bottom wall 61. The left wall 62 and the right wall 63 support the main unit frame 14, described below.

Figure 3:
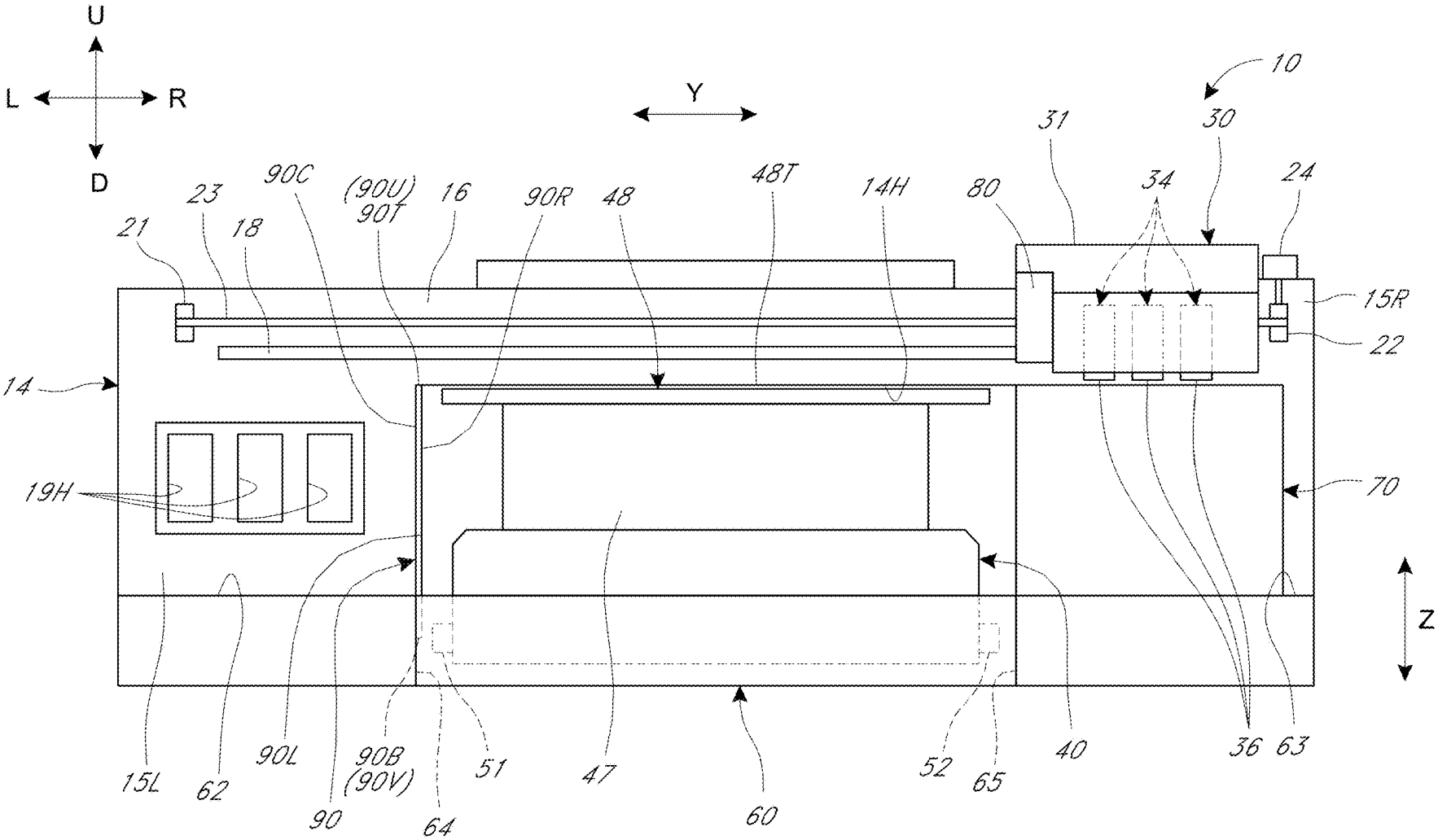
FIG. 3 is a front elevational view of a printer in a state wherein the main unit case is removed, according to one embodiment.

As illustrated in FIG. 3, the main unit frame 14 is provided on the base member 60. The main unit frame 14 comprises: a left base wall 15L that extends upward from the left wall 62 of the base member 60; a right base wall 15R that extends upward from the right wall 63 of the base member 60; and a supporting wall 16 that connects the top end of the left base wall 15L and the top end of the right base wall 15R. The left base wall 15L is positioned further to the left than the table unit 40. The right base wall 15R is positioned further to the right than the table unit 40. The supporting wall 16 extends in the primary scanning direction Y. The supporting wall 16 is disposed higher than the base member 60. In the printer 10, an opening 14H is structured so as to enable the table unit 40 to pass therethrough, passing in the secondary scanning direction X. The opening 14H is formed encompassed by the main unit frame 14 and the base member 60.

As illustrated in FIG. 2, the printer 10 comprises a guide rail 18 that is provided on the supporting wall 16. The guide rail 18 extends in the primary scanning direction Y. The guide rail 18 is provided along the front face of the supporting wall 16. The guide rail 18 is disposed higher than the opening 14H. The guide rail 18 is disposed higher than the table unit 40. The head carriage 32 of the ink head unit 30 is provided slidably on the guide rail 18. The guide rail 18 guides the movement of the head carriage 32 in the primary scanning direction Y.

As illustrated in FIG. 2, the carriage moving mechanism 20 is a mechanism for moving the head carriage 32 in the primary scanning direction Y relative to the printing medium 5 that is placed on the table 48, described below, of the table unit 40. The carriage moving mechanism 20 moves the head carriage 32 in the primary scanning direction Y. Note that there is no particular limitation on the structure of the carriage moving mechanism 20. The carriage moving mechanism 20 comprises a left pulley 21, a right pulley 22, a looped belt 23, and a head carriage motor 24. The left pulley 21 is provided further to the left than the left edge of the guide rail 18. The right pulley 22 is provided further to the right than the right end of the guide rail 18. The left pulley 21 and the right pulley 22 are secured to the supporting wall 16. The belt 23 is looped on the left pulley 21 and the right pulley 22.

The head carriage motor 24 is connected to the right pulley 22. However, the head carriage motor 24 may be connected instead to the left pulley 21. Here the head carriage motor 24 is driven to rotate the right pulley 22, to cause the belt 23 to travel between the left pulley 21 and the right pulley 22.

The head carriage 32 is attached to the belt 23. The head carriage 32 engages the guide rail 18 slidably. The head carriage 32 is disposed higher than the table 48. The belt 23 is caused to travel through driving of the head carriage motor 24, and the ink heads 34 and the light-emitting device 80, which are mounted on the head carriage 32, move in the primary scanning direction Y accompanying movement of the head carriage 32 in the primary scanning direction Y.

Figure 6:
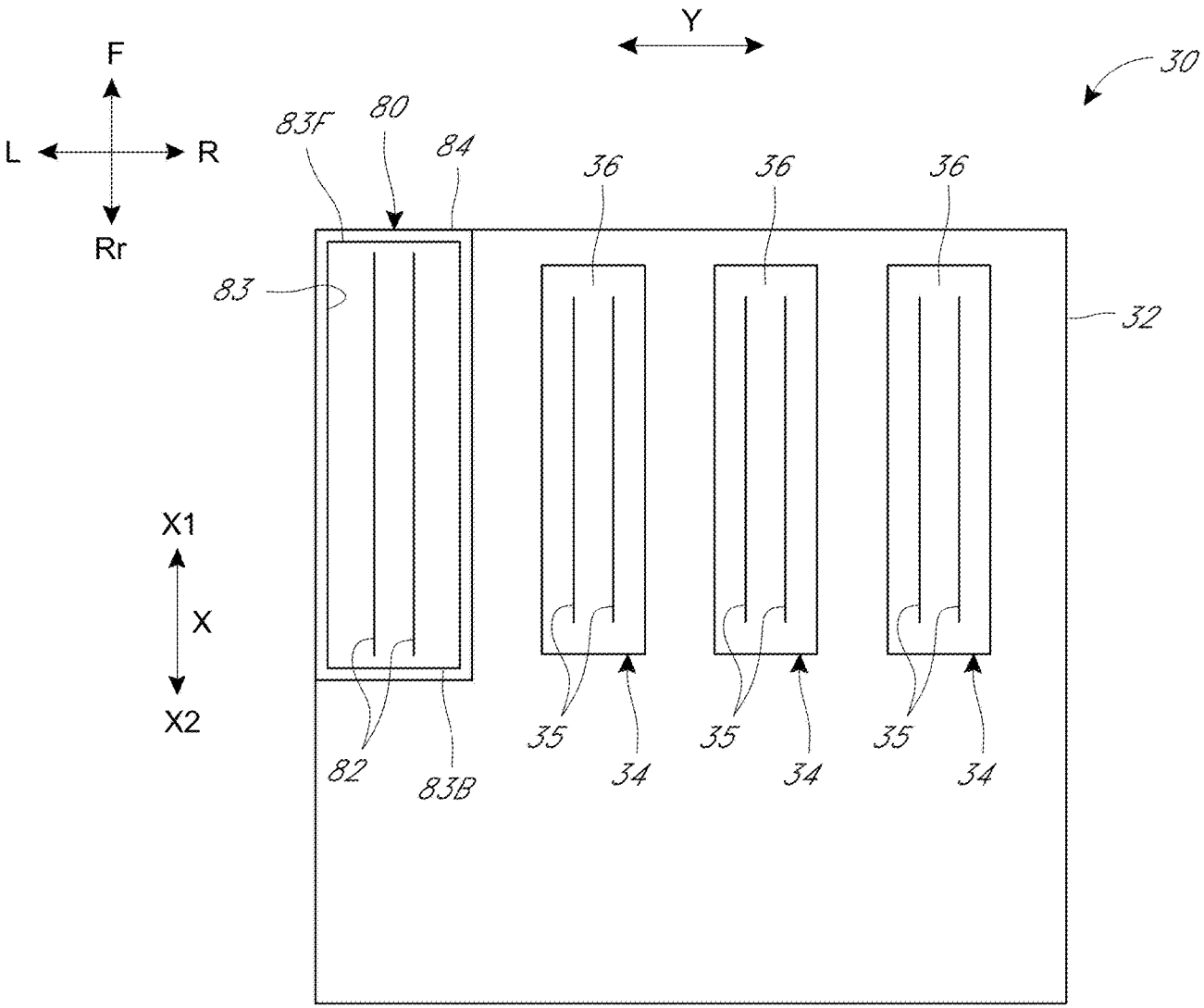
FIG. 6 is a schematic diagram depicting the structure of the surface of the side of the head carriage that faces the printing medium in one embodiment.

As illustrated in FIG. 6, the ink heads 34 are formed in a shape wherein the length in the secondary scanning direction X is longer than the length in the primary scanning direction Y. The ink heads 34 are formed so as to have identical shapes and identical sizes. Each of the ink heads 34 have a plurality of nozzles 35 that are lined up in the secondary scanning direction X, and a nozzle face 36 wherein the plurality of nozzles 35 is formed. In the ink heads 34, two rows of nozzles, structured from a plurality of nozzles 35, are provided. Each nozzle 35 is structured so as to enable discharging of ink onto the printing medium 5 that is placed on the table 48. A negative pressure (a pressure that is lower than the ambient pressure) is set in the nozzle 35. Because each nozzle 35 is extremely small, in FIG. 6 the plurality of nozzles 35 is represented by a straight line. In the present embodiment, the ink head unit 30 is provided with three ink heads 34; however four or more ink heads 34 may be provided instead. Moreover, while each ink head 34 is provided with two rows of nozzles, it may]

The ink heads 34 discharge photocurable ink, for example, as the ink. The photocurable ink may be, for example, ultraviolet radiation curable ink. Ultraviolet radiation curable ink has the property of curing when exposed to ultraviolet radiation. The ultraviolet radiation curable ink may be, for example, an ink for forming an image, or a primer and clear ink. The image forming ink is used for forming a printed image on the printing medium 5. The image forming ink includes a coloring agent, such as a pigment, a photopolymerizable monomer, and a photopolymerization initiator system, and, if necessary, may include various other types of additives such as, for example, a photosensitizing agent, a polymerization inhibitor, a scavenger, an oxidation inhibiting agent, an ultraviolet radiation absorbing agent, a plasticizing agent, a surface activating agent, a leveling agent, a thickening agent, a dispersing agent, a defoaming agent, a preservative, a solvent, or the like. The image forming ink is a colored ink. The image forming ink may be, for example, a process color ink or a white ink. The process color ink may be, for example, cyan ink, magenta ink, yellow ink, black ink, light cyan ink, light magenta ink, or the like. The primer is used to strengthen the adhesion between the printing medium 5 and the image forming ink. The primer does not include a coloring agent, such as a pigment, or the like, but does include a photopolymerizable monomer, a photopolymerization initiator system, and a binding agent (binding resin), and, as necessary, may include various types of additives, the same as with the image forming ink. The primer color may be, for example, transparent, white, gray, or the like. The clear ink is expelled onto the surface of the image forming ink, to satisfy the function of an overcoating layer covering the image forming ink. The clear ink does not include a coloring agent, such as a pigment, or the like, but does include a photopolymerizable monomer, and a photopolymerization initiator system, and, as necessary, may include various types of additives, the same as with the image forming ink.

The light-emitting device 80 is a device that emits light (for example, ultraviolet radiation) at the photocurable ink (for example, ultraviolet radiation curable ink) that has been discharged onto the printing medium 5. As illustrated in FIG. 2, the light-emitting device 80 is disposed to the left of the ink head 34. The light-emitting device 80 is secured to the head carriage 32. The light-emitting device 80 is configured to enable movement in the primary scanning direction Y along the guide rail 18, through the head carriage 32. In the present embodiment, the light-emitting device 80 is disposed to the left of the ink head 34; however, there is no limitation thereto. The light-emitting device 80 may instead be disposed to the right of the ink head 34.

As illustrated in FIG. 6, the light-emitting device 80 can comprise a light source 82 for emitting light toward the photocurable ink that has been discharged onto the printing medium 5 and a case 84 for containing the light source 82, wherein is formed an opening 83 through which light passes. The light-emitting device 80 comprises a plurality of light sources 82 that are lined up in the secondary scanning direction X.

In the light-emitting device 80, two rows of light sources are provided, which can be considered as a structure of the plurality of light sources 82. Note that the plurality of light sources 82 is represented as a straight line in FIG. 6. The light sources 82 may be, for example, LEDs. The front edge 83F of the opening 83 is positioned further to the front than the nozzle 35 that is positioned the furthest toward the front in the ink head 34. The rear edge 83B of the opening 83 is positioned further rearward than the nozzle 35 that is positioned the furthest rearward in the ink head 34. The bottom face of the case 84 is positioned higher than the nozzle face 36.

With reference to FIGS. 2 and 3, the table moving mechanism 38 is a mechanism for moving the table 48 of the table unit 40 in the secondary scanning direction X. As illustrated in FIG. 3, the table unit 40 comprises a table 48 and a table carriage 47 for supporting the table 48 so as to enable movement in the secondary scanning direction X.

Figure 4:
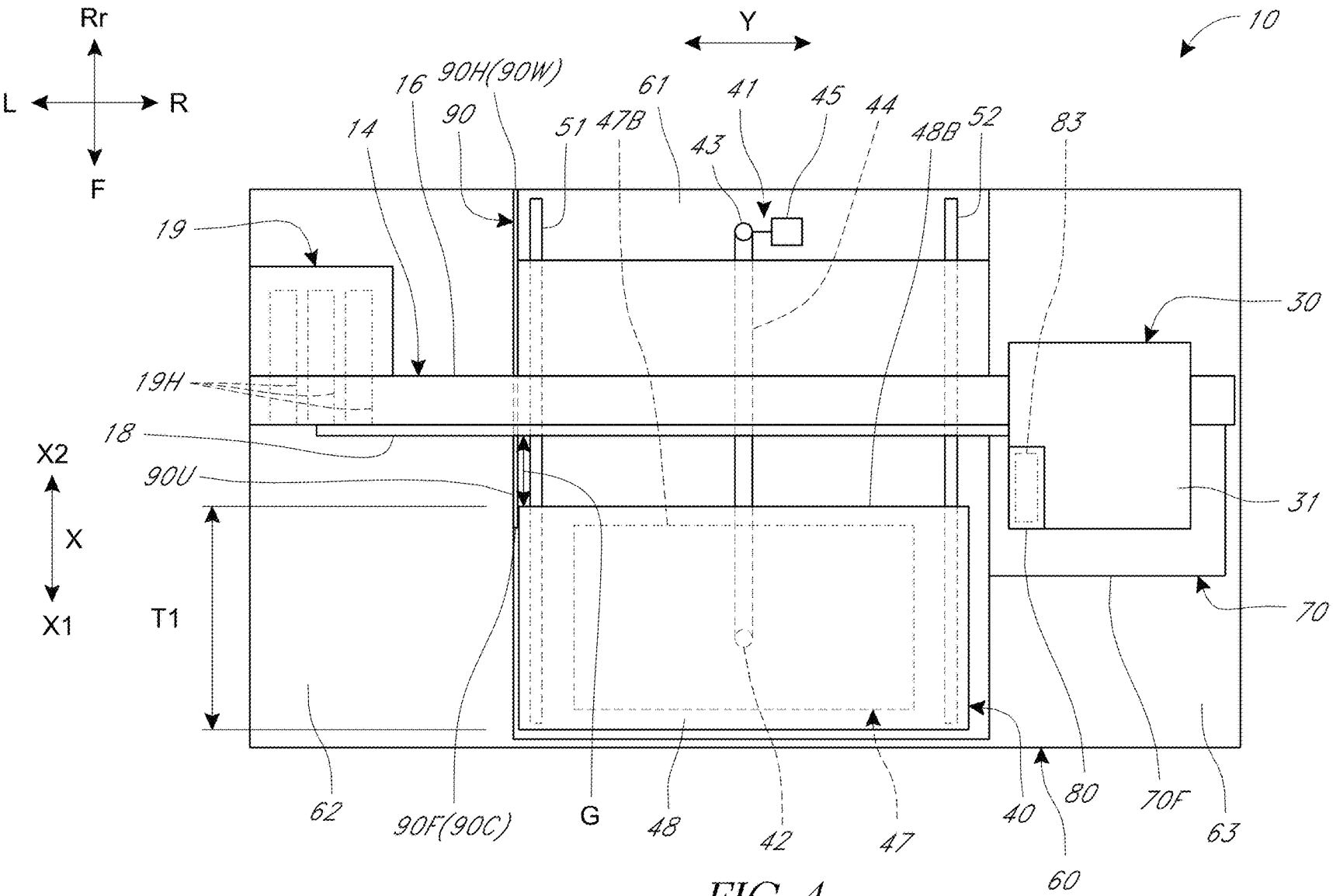
FIG. 4 is a top plan view of a printer in a state wherein the main unit case is removed, according to one embodiment, depicting a state wherein the table is positioned maximally toward the downstream side in the secondary scanning direction.

The table carriage 47 is supported on the first slide rail 51 (referencing also FIG. 4) and the second slide rail 52 (referencing also FIG. 4).

As illustrated in FIG. 2, the printing medium 5 is placed on the table 48. The table 48 is formed in a rectangle wherein the length in the secondary scanning direction X is shorter than the length in the primary scanning direction Y. Note that in the table 48, the length in the secondary scanning direction X may instead be longer than the length in the primary scanning direction Y, or the length in the secondary scanning direction X may be identical to the length in the primary scanning direction Y. As illustrated in FIG. 3, the table 48 is disposed lower than the supporting wall 16. The table 48 is disposed lower than the ink head unit 30. The table 48 is structured so as to enable movement thereof in the secondary scanning direction X by a moving device 41 (referencing FIG. 4).

Figure 5:
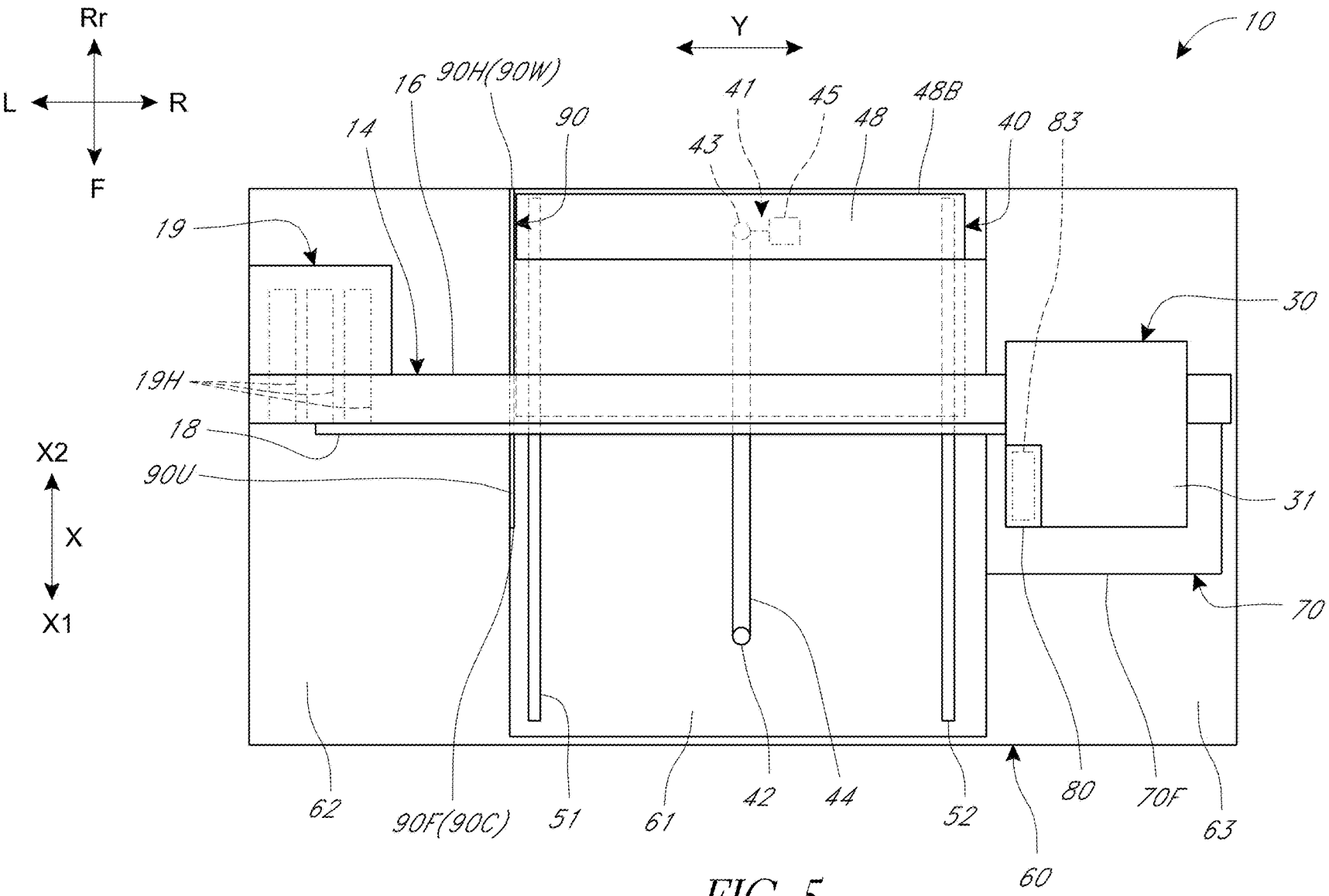
FIG. 5 is a top plan view of a printer in a state wherein the main unit case is removed, according to one embodiment, depicting a state wherein the table is positioned maximally toward the upstream side in the secondary scanning direction.

As illustrated in FIG. 4, the moving device 41 is disposed on the base member 60. The moving device 41 comprises a front pulley 42, a back pulley 43, a looped belt 44, and a driving motor 45. The front pulley 42 is provided on the front side of the bottom wall 61 of the base member 60. The back pulley 43 is provided on the back side of the bottom wall 61. The belt 44 is looped on the front pulley 42 and the back pulley 43. A driving motor 45 is connected to the back pulley 43. The driving motor 45 may be connected to the front pulley 42 instead. Here the driving motor 45 is driven to rotate the back pulley 43, to thereby cause the belt 44 to travel between the front pulley 42 and the back pulley 43. The table carriage 47 of the table unit 40 is attached to the belt 44. Because of this, when the belt 44 is caused to travel by driving of the driving motor 45, the table unit 40 will move in the secondary scanning direction X along the first slide rail 51 and the second slide rail 52. That is, the moving device 41 is able to move the table 48 in the secondary scanning direction X (that is, in the outbound direction X1 and the return direction X2). FIG. 4 depicts the state wherein the table 48 is at the maximally downstream side (which here is maximally forward) in the secondary scanning direction X. Additionally, FIG. 5 depicts the state wherein the table 48 is positioned at the maximally upstream side (which here is maximally rearward) in the secondary scanning direction X. Note that, for convenience in explanation, the depiction of the carriage moving mechanism 20 is omitted from FIG. 4 and FIG. 5.

As illustrated in FIG. 5, the printer 10 comprises an ink cartridge storing portion 19, with a plurality of openings 19H, that contain an ink cartridges (not shown). The ink cartridges store ink.

An ink cartridge is connected to the ink head 34 (referencing FIG. 6). An ink cartridge storing portion 19 is provided rearward of the main unit frame 14. The ink cartridge storing portion 19 is provided on the left wall 62 of the base member 60. In the present embodiment, three ink cartridge storing portions 19 are provided lined up against the primary scanning direction Y. Note that the number of ink cartridge storing portions 19 is not limited to 3. As illustrated in FIG. 3, the ink cartridge is structured so as to be inserted into the ink cartridge storing portion 19 through an opening 19H that is formed in the left base wall 15L of the main unit frame 14.

The maintenance device 70 comprises a wiping device for wiping the nozzle face 36 of the ink head 34, and a cleaning device for forcibly sucking ink from the nozzle 35 of the ink head 34. As illustrated in FIG. 2, the maintenance device 70 is provided on a right wall 63 of a base member 60. The maintenance device 70 is provided further forward than the main unit frame 14. The maintenance device 70 is disposed further to the right than the table unit 40. The maintenance device 70 is disposed lower than the ink head unit 30. As illustrated in FIG. 4, the front and 70F of the maintenance device 70 is positioned further to the downstream side of (which here is toward the front) in the secondary scanning direction X than the end portion 48B of the upstream side, in the secondary scanning direction X, of the table 48 when the table 48 is positioned at the maximal downstream side in the secondary scanning direction X.

As illustrated in FIG. 2, the printer 10 comprises a partitioning wall 90 for preventing access to the interior of the movement space of the table 48 (for example, the bottom wall 61 of the base member 60) from outside of the movement space of the table 48 (for example, over the left wall 62 of the base member 60). As illustrated in FIG. 3, the partitioning wall 90 is structured from a plate-shaped member, and comprises a pair of wall faces (a left face 90L and a right face 90R) that are perpendicular to the primary scanning direction Y, and end faces (a front face 90C, a top face 90U, a bottom face 90V, and a back face 90W) that connect the pair of wall faces, and is disposed lower than the supporting wall 16.

As illustrated in FIG. 4, the partitioning wall 90 is disposed to the side (which here is the left side) of the table 48 in the primary scanning direction Y. The partitioning wall 90 is disposed to the right of the left base wall 15L (referencing FIG. 2). The partitioning wall 90 is positioned between the ink cartridge storing portion 19 (referencing FIG. 4) and the table 48 in relation to the primary scanning direction Y. Of the partitioning walls 90, the pair of wall faces (the left face 90L and the right face 90R) extend in the secondary scanning direction X and the vertical direction Z.

As illustrated in FIG. 3, the top end 90T of the top face 90U of the partitioning wall 90 is positioned higher than the top end 48T of the table 48. The top end 90T of the top face 90U of the partitioning wall 90 is positioned lower than the nozzle face 36 of the ink head 34. The top face 90U of the partitioning wall 90 supports the supporting wall 16. That is, the top end 90T of the top face 90U of the partitioning wall 90 contacts the supporting wall 16. The bottom end 90B of the bottom face 90V of the partitioning wall 90 is connected to the base member 60. Here the bottom end 90B of the partitioning wall 90 is secured to the left side wall 64 of the base member 60. The bottom end 90B of the bottom face 90V of the partitioning wall 90 is positioned lower than the left wall 62.

In FIG. 4, the table 48 is positioned at the maximally downstream side (which here is maximally forward) in the secondary scanning direction X. In this position, the end portion 48B on the upstream side, in the secondary scanning direction X, of the table 48 is positioned further toward the upstream side (which here is rearward), than the end portion 90F of the downstream side of the partitioning wall 90, and further toward the downstream side, of the supporting wall 16 (which here is the guide rail 18). When the table 48 is positioned at the maximally downstream side (which here is maximally forward) in the secondary scanning direction X, the end portion 90F of the downstream side of the partitioning wall 90 is positioned further to the upstream side (which here is rearward) than an intermediate position T1 of the table 48. Further, when the table 48 is positioned at the maximally downstream side (which here is maximally forward) in the secondary scanning direction X, the end portion 90F of the downstream side of the partitioning wall 90 is positioned further toward the downstream side (which here is forward) than the end portion 47B of the downstream side of the table carriage 47 of the table unit 40.

The table carriage 47 can be formed with the length thereof in the secondary scanning direction X and the length thereof in the primary scanning direction Y being less than those of the table 48. Because of this, below the table 48, there would be a larger gap wherein it would be possible to access the interior of the movement space (for example, the bottom wall 61 of the base member 60) of the table 48 from outside of the movement space (for example, from over the left wall 62 of the base member 60) of the table 48.

However, because the partitioning wall 90 is disposed to the side of the table carriage 47, access to the interior of the movement space of the table 48 is prevented.

The end portion 90F of the partitioning wall 90 on the downstream side, in the secondary scanning direction X, is positioned further to the downstream side (which here is forward) than the opening 83 of the light-emitting device 80. The end portion 90H on the upstream side of the partitioning wall 90, in the secondary scanning direction X, is positioned further to the upstream side (which here is rearward) than the supporting wall 16. The end portion 90H (which here is the back face 90W) on the upstream side of the partitioning wall 90, in the secondary scanning direction X, is positioned further to the upstream side (which here is rearward) than the first slide rail 51 and the second slide rail 52.

As illustrated in FIG. 3, with regard to the partitioning wall 90, the wall faces that are perpendicular to the primary scanning direction Y (that is, the left face 90L as a first wall face and the right face 90R as a second wall face) are structured so as to be able to reflect the light emitted from the light source 82 of the light-emitting device 80. The partitioning wall 90 may be formed, for example, from a metal material such as stainless steel, or the like. Note that the left face 90L and right face 90R of the partitioning wall 90 may be structured to enable absorption of the light that is emitted from the light source 82. In this case, the left face 90L and the right face 90R of the partitioning wall 90 may use a conventionally known material that absorbs light. Additionally, the wall faces may be colored black, or the partitioning wall 90 may be formed from a black resin material. That is, the structure may be such that the light emitted from the light source 82 is blocked by one wall face (for example, the left face 90L), so as to not arrive at the other wall face (for example, the right face 90R).

As described above, in the printer 10 according to some embodiments, the partitioning wall 90 is positioned to the side of the table 48 (which here is the left side) in the primary scanning direction Y, and lower than the supporting wall 16, and extends in the secondary scanning direction X and the vertical direction Z. The partitioning wall 90 is structured such that when the table 48 is positioned at the maximally downstream side of the secondary scanning direction X, the end portion 48B of the upstream side of the table 48, in the secondary scanning direction X, is positioned further to the downstream side than the supporting wall 16. That is, a gap G (referencing FIG. 4) exists between the table 48 and the supporting wall 16. However, when the table 48 is positioned at the maximally downstream side in the secondary scanning direction X, the end portion 48B on the upstream side of the table 48, is positioned further to the upstream side than the end portion 90F on the downstream side of the partitioning wall 90. As such, the gap G is blocked by the partitioning wall 90 that is disposed to the side of the table 48, and thus entry of a relatively large article, such as a tool, or the like, into the movement space (for example, over the bottom wall 61 of the base member 60) of the table 48 through the gap G from the side of the table 48 is prevented.

In the printer 10 according to some embodiments, the top end 90T of the partitioning wall 90 is positioned higher than the top end 48T of the table 48. Through this, the gap G that occurs between the table 48 and the supporting wall 16 can be blocked more reliably through the partitioning wall 90 that is disposed to the side (which here is to the left) of the table 48. This makes it possible to prevent, more reliably, access into the interior of the movement space from outside of the movement space.

In the printer 10 according some embodiments, when the table 48 is positioned at the maximally downstream side in the secondary scanning direction X, the end portion 90F on the downstream side of the partitioning wall 90, in the secondary scanning direction X, is positioned further to the upstream side than an intermediate position T1 of the table 48. For example, when hardware for securing the printing medium 5 is attached to the table 48, if the length of the partitioning wall 90, in the secondary scanning direction X, were too long, the partitioning wall 90 could become an impediment when attaching the hardware. However, because the end portion 90F on the downstream side of the partitioning wall 90, in the secondary scanning direction X, is positioned further to the upstream side than the intermediate position T1 of the table 48, the effect on the partitioning wall 90 when attaching the hardware will be reduced. That is, the hardware can be attached more easily to the table 48.

In the printer 10 according to some embodiments, the partitioning wall 90 is connected to the base member 60 and supports the supporting wall 16. Through this, the gap G that is produced between the table 48 in the supporting wall 16 can be blocked more reliably, along the vertical direction Z, by the partitioning wall 90 that is disposed to the side (which here is the left side) of the table 48.

In the printer 10 according to some embodiments, the end portion 90H on the upstream side of the partitioning wall 90, in the secondary scanning direction X, is positioned further to the upstream side than the supporting wall 16. This enables the supporting wall 16 to be supported more stably by the partitioning wall 90.

The printer 10 according to some embodiments comprises a light-emitting device 80 that has a light source 82 for emitting light toward the photocurable ink that has been discharged onto the printing medium 5. The partitioning wall 90 has a left face 90L and a right face 90R that are perpendicular to the primary scanning direction Y. The partitioning wall 90 is structured so that the light that is emitted from the light source 82 when the light source 82 is disposed on the left face 90L side, will be blocked by the left face 90L, so as to not arrive at the right face 90R, in respect to the primary scanning direction Y. Through this, arrival of the reflected light at an article that is positioned to the side of the table 48 (for example, the left wall 62 of the base member 60) in the primary scanning direction Y at the ink head 34 is prevented.

The printer 10 according to some embodiments comprises a light-emitting device 80 that has a light source 82 for emitting light toward the photocurable ink that has been discharged onto the printing medium 5 and a case 84 for containing the light source 82, wherein is formed an opening 83 through which light passes. The end portion 90F of the downstream side of the partitioning wall 90, in the secondary scanning direction X, is positioned further toward the downstream side than the opening 83. Through this, arrival of the reflected light at an article that is positioned to the side of the table 48 (for example, the left wall 62 of the base member 60) in the primary scanning direction Y at the ink head 34 is prevented.

The printer 10 according to some embodiments comprises an ink cartridge storing portion 19 for containing an ink cartridge that stores ink and that is connected to the ink head 34. The partitioning wall 90 is positioned between the ink cartridge storing portion 19 and the table 48 in respect to the primary scanning direction Y. When replacing the ink cartridge or when performing maintenance on the ink cartridge storing portion 19, a prescribed tool is used. Here entry of the tool, or the like, into the interior of the movement space (for example, over the bottom wall 61 of the base member 60) of the table 48 through the gap G from the side of the table 48, is prevented because the G that is produced between the table 48 and the supporting wall 16 is blocked by the partitioning wall 90 that is disposed to the side (which here is to the left) of the table 48.

Some embodiments of the present inventions are explained above. However, each embodiment described above is no more than illustrative, and the present inventions may be carried out in a variety of other forms.

While, in some embodiments set forth above, the top end 90T of the partitioning wall 90 contacts the supporting wall 16 to support the supporting wall 16, the top end 90T of the partitioning wall 90 need not necessarily contact the supporting wall 16.

While in some embodiments set forth above, the bottom end 90B of the partitioning wall 90 was secured to the base member 60, the bottom end 90B of the partitioning wall 90 need not necessarily be secured to the base member 60.

Figure 7:
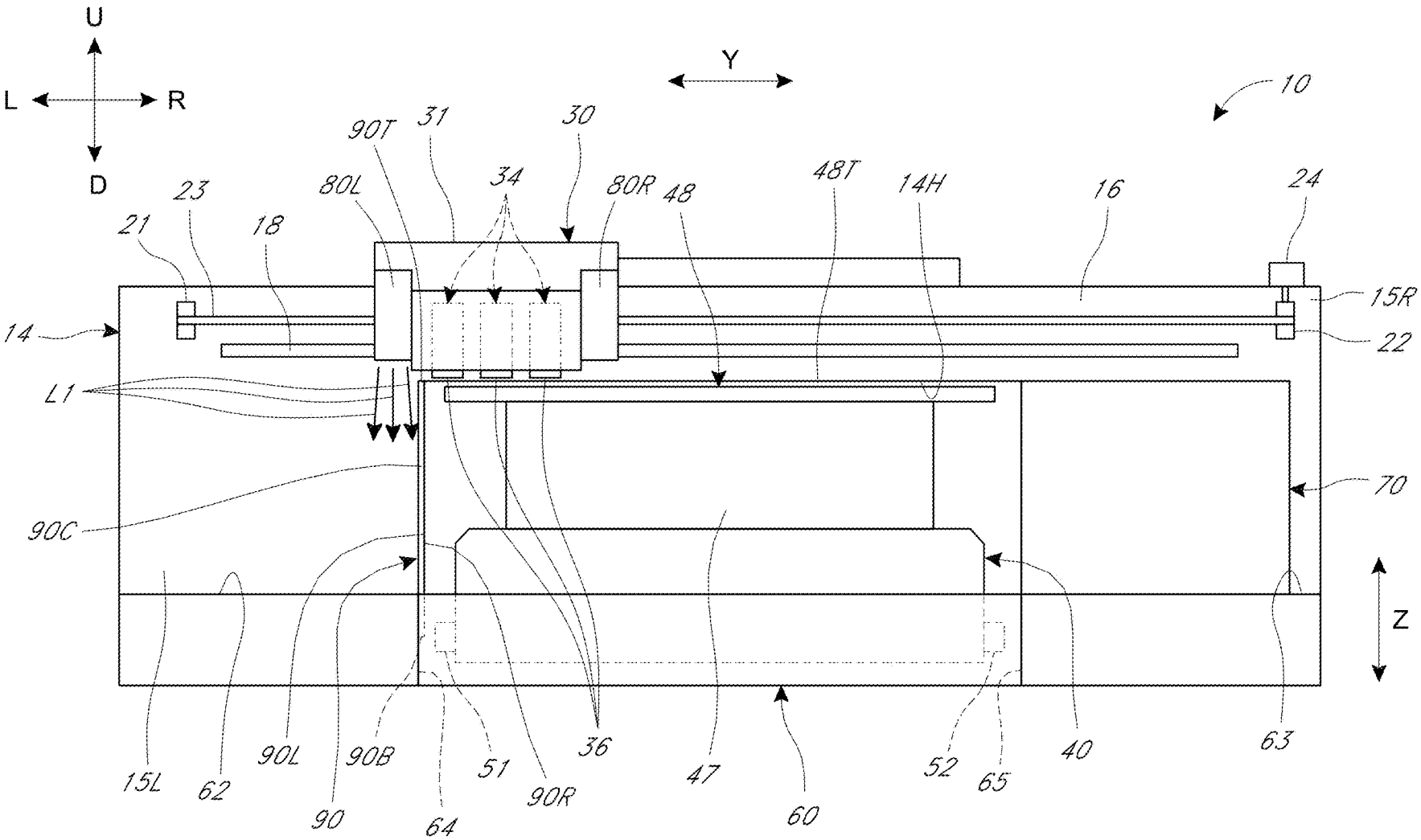
FIG. 7 is a front elevational view of a printer in a state wherein the main unit case is removed, according to another embodiment.

While in some embodiments set forth above, the ink head unit 30 was equipped with only the light-emitting device 80 that was disposed further to the left of the ink head 34, there is no limitation thereto. For example, as illustrated in FIG. 7, the ink head unit 30 may comprise a left side light-emitting device 80L that is disposed further to the left than the ink head 34, and a right side light-emitting device 80R that is disposed further to the right than the ink head 34. Note that the left side light-emitting device 80L and the right side light-emitting device 80R can be structured identically to the light-emitting device 80.

Figure 8:
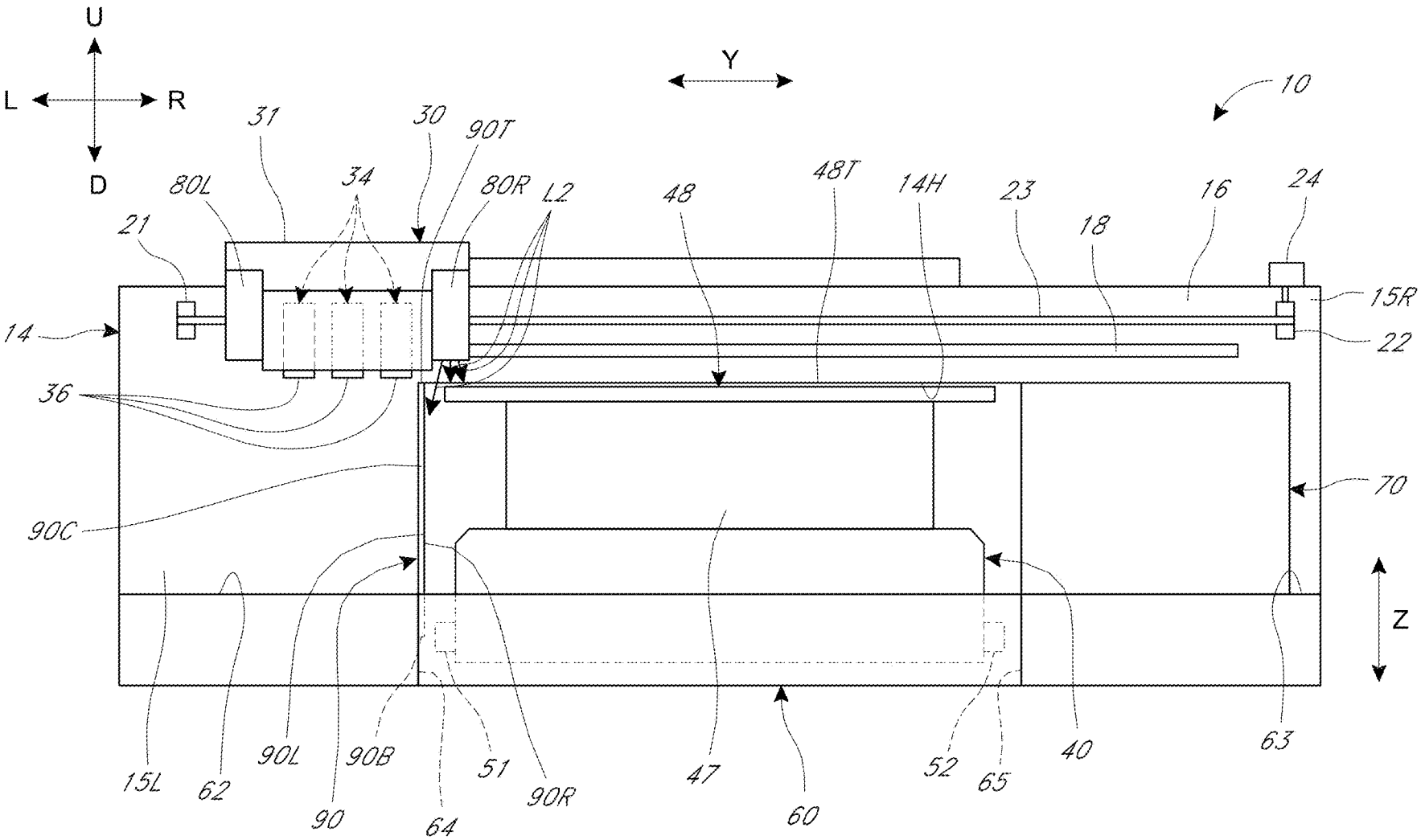
FIG. 8 is a front elevational view of a printer in a state wherein the main unit case is removed, according to another embodiment.

As illustrated in FIG. 7, when the left side light-emitting device 80L emits a light in a state wherein it is positioned further to the left than the partitioning wall 90 and the ink head 34 is positioned further to the right than the partitioning wall 90, the light that is emitted can be reflected by the left wall 62 of the base member 60, as indicated by the arrow L1 of FIG. 7, but the presence of the partitioning wall 90 can prevent the emitted light (including the reflected light) from arriving at the ink head 34. Additionally, as illustrated in FIG. 8, when the right side light-emitting device 80R emits a light in a state wherein it is positioned further to the right than the partitioning wall 90 and the ink head 34 is positioned further to the left than the partitioning wall 90, the light that is emitted can be reflected by the table 48, as indicated by the arrow L2 of FIG. 8, but the presence of the partitioning wall 90 can prevent the emitted light (including the reflected light) from arriving at the ink head 34. Note that illustrations of the openings 19H are omitted from FIG. 7 and FIG. 8.

What is claimed is:

1. An inkjet printer, comprising:

a base member;

a supporting wall that is positioned higher than the base member and that extends in a primary scanning direction;

a placement platform that is positioned lower than the supporting wall, is structured so as to be able to move in a secondary scanning direction that is a direction that is perpendicular to the primary scanning direction, and on which a printing medium is placed;

a moving device for moving the placement platform in an outbound direction that is the direction from the upstream side to the downstream side of the secondary scanning direction and in a return direction that is the direction from the downstream side toward the upstream side of the secondary scanning direction;

a guide rail that is provided on the supporting wall and that extends in the primary scanning direction;

a carriage that is provided slidably on the guide rail and that can move in the primary scanning direction;

an ink head that is installed on the carriage and that is structured so as to be able to discharge ink toward a printing medium that is placed on the placement platform; and a partitioning wall that is positioned entirely below the supporting wall and to a side of the placement platform in the primary scanning direction, and that extends in the secondary scanning direction and in the vertical direction;

wherein: the partitioning wall is connected to the base member and supports the supporting wall; and wherein: when the placement platform is positioned at the maximally downstream side in the secondary scanning direction, an end portion on the upstream side, in the secondary scanning direction, of the placement platform is positioned further toward the downstream side in the secondary scanning direction than the supporting wall, and further toward the upstream side in the secondary scanning direction than the end portion of the downstream side, in the secondary scanning direction, of the partitioning wall.

2. An inkjet printer as set forth in claim 1, wherein:

a top end of the partitioning wall is positioned higher than a top end of the placing platform.

3. An inkjet printer as set forth in claim 1, wherein:

when the placement platform is positioned at the maximally downstream side in the secondary scanning direction, the end portion on the downstream side, in the secondary scanning direction, of the partitioning wall is positioned further to the upstream side in the secondary scanning direction than an intermediate position, in the secondary scanning direction, of the placement platform.

4. An inkjet printer as set forth in claim 1, wherein: the end portion of the upstream side, in the secondary scanning direction, of the partitioning wall is positioned further to the upstream side in the secondary scanning direction than the supporting wall.

5. An inkjet printer as set forth in claim 1, wherein:

the ink head discharges photocurable ink as the ink;

a light-emitting device has a light source for emitting light toward the photocurable ink that has been discharged onto the printing medium;

the partitioning wall comprises a first wall face and a second wall face that are perpendicular to the primary scanning direction;

the partitioning wall is structured so that when the light source is disposed on the first wall surface side, in relation to the primary scanning direction, the light that is emitted from the light source is blocked by the first wall face so as to not arrive at the second wall surface side.

6. An inkjet printer as set forth in any one of claim 1, wherein:

the ink head discharges photocurable ink as the ink;

a light-emitting device has a light source for emitting light toward the photocurable ink that has been discharged onto the printing medium, and a case for containing the light source and including an opening through which light passes;

an end portion on the downstream side, in the secondary scanning direction, of the partitioning wall is positioned further to the downstream side in the secondary scanning direction than the opening.

7. An inkjet printer as set forth in claim 1, wherein:

an ink storing portion wherein is contained an ink cartridge configured to store ink and to connect to the ink head, wherein:

the partitioning wall is positioned between the ink cartridge storing portion and the placement platform, in respect to the primary scanning direction.

8. An inkjet printer, comprising:

a base member;

a supporting wall positioned higher than the base member and extending in a primary scanning direction;

a placement platform configured to support a printing medium, in use, and being positioned lower than the supporting wall, the placement platform being configured to move in a secondary scanning direction perpendicular to the primary scanning direction, between a maximum upstream position and a maximum downstream position, the placement platform comprising an upstream end portion;

a drive mechanism configured to move the placement platform in outbound and return directions between the maximum upstream position and the maximum downstream position of the secondary scanning direction, the outbound direction being from the upstream end toward the downstream end and the return direction being from the downstream end toward the upstream end;

a guide rail disposed on the supporting wall and extending along the primary scanning direction;

a carriage slidably mounted on the guide rail and configured to move along the primary scanning direction;

an ink head supported on the carriage and configured to discharge ink toward a printing medium supported on the placement platform, in use; and a partitioning wall positioned entirely below the supporting wall and to a side of the placement platform in the primary scanning direction, the partitioning wall extending in the secondary scanning direction and in a vertical direction, the partitioning wall comprising a downstream end portion along the secondary scanning direction;

wherein the partitioning wall is connected to the base member and supports the supporting wall; and wherein:

when the placement platform is positioned at the maximum downstream position, the upstream end portion of the placement platform is positioned further downstream along the secondary scanning direction than the supporting wall, and further upstream along the secondary scanning direction than the downstream end portion of the partitioning wall.

9. An inkjet printer as set forth in claim 8, wherein a top end of the partitioning wall is positioned higher than a top end of the placement platform.

10. An inkjet printer as set forth in claim 8, wherein when the placement platform is positioned at the maximum downstream position along the secondary scanning direction, the downstream end portion of the partitioning wall is positioned further upstream than an intermediate position of the placement platform.

11. An inkjet printer as set forth in claim 8, wherein the partitioning wall further comprises an upstream end portion being positioned further upstream along the secondary scanning direction than the supporting wall.

12. An inkjet printer as set forth in claim 8, wherein the ink head is configured to discharge a photocurable ink as the ink, the inkjet printer further comprising a light-emitting device including a light source configured to emit light toward the photocurable ink after it has been discharged onto the printing medium, in use, wherein the partitioning wall further comprises a first wall face and a second wall face that are perpendicular to the primary scanning direction, the partitioning wall being configured to block light from the light source such that when the light source is disposed on a side of the first wall face, in relation to the primary scanning direction, the light that is emitted from the light source is blocked by the first wall face so as to not arrive at a side of the second wall face.

13. An inkjet printer as set forth in claim 8, wherein the ink head is configured to discharge a photocurable ink as the ink, the inkjet printer further comprising a light-emitting device including a light source configured to emit light toward the photocurable discharged onto the printing medium in use, and a case for containing the light source and including an opening through which light passes, wherein the downstream end portion of the partition wall is positioned further downstream than the opening.

14. An inkjet printer as set forth in claim 8, further comprising an ink storing portion and an ink cartridge disposed in the ink storing portion, wherein the partitioning wall is positioned between the ink cartridge storing portion and the placement platform, with respect to the primary scanning direction.

* * * * *